US011383508B2

(12) United States Patent
Lindner

(10) Patent No.: US 11,383,508 B2
(45) Date of Patent: Jul. 12, 2022

(54) CURING STATION AND METHOD FOR CURING PRINTING INK OF A DIRECT PRINT ON CONTAINERS

(71) Applicant: KRONES AG, Neutraubling (DE)

(72) Inventor: Peter Lindner, Neutraubling (DE)

(73) Assignee: KRONES AG, Neutraubling (DE)

( * ) Notice: Subject to any disclaimer, the term of this patent is extended or adjusted under 35 U.S.C. 154(b) by 624 days.

(21) Appl. No.: 16/325,713

(22) PCT Filed: May 10, 2017

(86) PCT No.: PCT/EP2017/061110
§ 371 (c)(1),
(2) Date: Feb. 14, 2019

(87) PCT Pub. No.: WO2018/041422
PCT Pub. Date: Mar. 8, 2018

(65) Prior Publication Data

US 2021/0354482 A1 Nov. 18, 2021

(30) Foreign Application Priority Data

Sep. 2, 2016 (DE) ..... 10 2016 216 627.1

(51) Int. Cl.
*B41F 23/04* (2006.01)
*B41J 3/407* (2006.01)
*B41J 11/00* (2006.01)

(52) U.S. Cl.
CPC ..... *B41F 23/0409* (2013.01); *B41F 23/0486* (2013.01); *B41J 3/4073* (2013.01); *B41J 3/40733* (2020.08); *B41J 11/00212* (2021.01); *B41J 11/00214* (2021.01)

(58) Field of Classification Search
CPC ..... B41J 11/00214; B41J 3/40733; B41J 11/00212; B41F 23/0486
See application file for complete search history.

(56) References Cited

U.S. PATENT DOCUMENTS

2003/0142195 A1 7/2003 Katsuma et al.

FOREIGN PATENT DOCUMENTS

| | | | |
|---|---|---|---|
| CN | 105015160 | A | 11/2015 |
| DE | 102005051470 | A1 | 4/2007 |
| DE | 602004009158 | T2 | 5/2008 |
| DE | 102009031479 | A1 | 1/2011 |
| DE | 102015200986 | A1 | 8/2015 |
| DE | 102014216576 | A1 | 2/2016 |
| EP | 2447070 | A1 | 5/2012 |
| EP | 2857198 | A1 | 4/2015 |

(Continued)

OTHER PUBLICATIONS

ISA European Patent Office, International Search Report Issued in Application No. PCT/EP2017/061110, dated Sep. 6, 2017, WIPO, 4 pages.

(Continued)

*Primary Examiner* — An H Do
(74) *Attorney, Agent, or Firm* — McCoy Russell LLP

(57) ABSTRACT

A curing station for curing printing ink of a direct print on containers, comprising a conveyor for conveying the containers preferably in container holders, and further comprising at least one UV light unit for curing the printing ink, characterized in that the at least one UV light unit comprises a 2D arrangement of UV LEDs for generating a UV light field for curing the printing ink.

14 Claims, 5 Drawing Sheets

(56) References Cited

FOREIGN PATENT DOCUMENTS

| | | |
|---|---|---|
| WO | 2012028215 A1 | 3/2012 |
| WO | 2014065081 A1 | 5/2014 |

OTHER PUBLICATIONS

China National Intellectual Property Administration of the People's Republic of China, Office Action and Search Report Issued in Application No. 201780053711.7, dated Mar. 3, 2020, 24 pages. (Submitted with Partial Translation).

CURING STATION AND METHOD FOR CURING PRINTING INK OF A DIRECT PRINT ON CONTAINERS

CROSS-REFERENCE TO RELATED APPLICATIONS

The present application is a U.S. National Phase of International Patent Application Serial No. PCT/EP2017/061110 entitled "CURING STATION AND METHOD FOR CURING PRINTING INK OF A DIRECT PRINT ON CONTAINERS," filed on May 10, 2017. International Patent Application Serial No. PCT/EP2017/061110 claims priority to German Patent Application No. 10 2016 216 627.1 filed on Sep. 2, 2016. The entire contents of each of the above-referenced applications are hereby incorporated by reference for all purposes.

TECHNICAL FIELD

The present invention relates to a curing station and a method for curing printing ink of a direct print on containers, as well as a direct printing machine for printing on containers, comprising at least one printing station and at least one curing station.

BACKGROUND AND SUMMARY

Making use of such a direct printing machine for printing on containers, the direct print is usually printed on the outer surface of the container by means of an ink jet printing process, e.g. for identifying and/or advertising the contents of the container. For curing the ink of the direct print, the ink is then irradiated with UV light in a curing station, which makes the printing ink scratch- and water-resistant.

In such curing stations, the containers are usually conveyed by a conveyor to a UV light unit, where they are irradiated with UV light. The use of mercury vapor lamps as UV lamps is well known, since these lamps have a sufficiently high irradiation power for the desired container throughput.

WO 2012/028215 discloses a process and a device used for treating containers and comprising several print modules and a drying and sterilization module, in which the imprint is cured or dried with a UV lamp.

The above is disadvantageous insofar as the use of such UV lamps is complicated and inflexible, since they normally require a long warm-up time, are subject to strong heat development, require eye protection due to the UV-C radiation and since ozone is produced during the treatment. Hence, the UV lamp requires complicated cooling and the ambient air has to be sucked off and filtered. Since UV lamps have a longer cooling-down time after having been switched off, there is the risk that, in the event of rapid intervention in response to a machine alarm, the user may get injured and burned. In addition, the UV lamp must first warm up to the operating temperature after the machine has been started, before the desired UV spectrum is emitted. Moreover, the radiation output cannot be controlled and there is no possibility of flexibly adapting the light field to the container shape or the size of the direct print.

Therefore, it is the object of the present invention to provide a curing station and a direct printing machine, which can be used in a less complicated and more flexible manner.

For solving this posed task, the present invention provides a curing station.

Due to the fact that the at least one UV light unit comprises the 2D arrangement of UV LEDs as a light source, the UV light is generated more efficiently by means of LED technology and can be switched particularly fast. Hence, the UV light unit develops less heat and can be switched on and off particularly fast, without any warm-up time. Due to the fact the present light source is not a single UV light source but a 2D arrangement of a plurality of LEDs, the LEDs can be controlled individually, so that the UV light field will be adapted to the actual curing demands individually to the container shape and the size of the direct print, respectively. In addition, a particularly high radiation output can be achieved by the 2D arrangement of UV LEDs. Moreover, due to the adaptation of the UV light field, the containers can be moved past the UV light unit at a particularly small distance therefrom, without the surface area positioned closest to the UV light source being excessively irradiated or heated. As a result, the entire radiation output required is not as high as in the case of known UV lamps. Due to the narrow-band radiation characteristic of UV LEDs, it is also easier to take protective measures as regards machine protection by providing viewing windows that filter out only the spectrum of the UV LEDs or attenuate it to a level that is harmless to human beings.

UV LEDs prove to be particularly advantageous in emergency situations, where, for example, the machine requires manual intervention, i.e. the machine protection has to be opened. Due to the lower operating temperature compared to e.g. mercury vapor lamps, the risk of injury or burning is much lower.

The use of UV LEDs also increases the machine availability because after a malfunction in the direct printing machine has been eliminated, the machine can be restarted immediately, without having to wait until a warm-up and settling phase of the high-pressure or low-pressure vapor lamps has elapsed.

It follows that the UV light unit comprising the 2D arrangement of UV LEDs requires less effort and is more flexible in use.

Direct print can be defined as a print applied directly to a container by means of a direct printing head. The direct printing head may be configured to deliver individual print drops directly onto a container. In addition, the direct printing head may be controllable via digital control signals for delivering the print drops onto the container. The direct printing head may comprise one or a plurality of rows of nozzles for delivering the print drops onto the container.

The curing station may be arranged downstream of, or may be integrated in a direct printing machine for applying the direct print to the containers. For example, a direct printing station and the curing station may be combined into a block so as to form a direct printing machine. The curing station and the direct printing machine, respectively, may be arranged in a beverage processing plant and may preferably be arranged downstream of a filling plant, which is used for filling a product into the containers, and/or a capper. The curing station and the direct printing machine may, however, also be arranged upstream of the filling process and/or directly downstream of a container manufacturing process.

The containers may be provided for accommodating therein beverages, hygiene articles, pastes, chemical, biological and/or pharmaceutical products. In general, the containers may be provided for any flowable or fillable media. The containers can be made of plastic, glass or metal, but hybrid containers with material mixtures are imaginable as well. The containers may be bottles, cans and/or tubes. The containers may be specially shaped containers with at least one surface deviating from the rotational symmetry around the longitudinal axis of the container. The specially shaped containers may comprise at least one relief-like surface area.

The conveyor may be configured as a carousel rotatable about a vertical axis. "Vertical" may here mean that this is the direction which is directed to the center of the earth. It is also imaginable that the conveyor is configured as a linear conveying unit. In addition, the conveyor may comprise two or more deflection starwheels with a conveyor belt guided thereby, so that linear and circular-arc-shaped conveying sections are formed for conveying the containers. For accommodating the containers, the conveyor may comprise container holders, which are arranged e.g. at the circumference of the carousel or at the conveyor belt. The container holders may each comprise a rotary table for accommodating the container base and/or a centering bell for accommodating the container mouth. Making use of direct drives or of a control cam, the container holders may be configured for rotating the containers relative to the curing station during curing. Various sides of the container can thus be cured. The conveyor may be configured for conveying the containers continuously or intermittently.

The direct print may comprise, or may be, a print image applied to the containers by means of an ink jet printing process. The printing ink of the direct print may be a printing ink curable by the UV light field of the UV light unit. The printing ink may preferably be curable by UV light. UV light may here mean ultraviolet light. The printing ink may comprise color pigments, a polymerizable matrix, monomers, oligomers, UV initiators, water or solvents. The printing ink may comprise monomers and/or oligomers, which are adapted to be crosslinked by radicals formed from the UV initiator by UV light, or by electron beams. The printing ink may comprise a color consisting of yellow, cyan, magenta, black or white or any mixed color thereof.

The UV light unit may comprise a carrier having the UV LEDs arranged thereon. In addition, the UV light unit may comprise a circuit board or the like, by means of which the UV LEDs can be electrically controlled, individually or in groups. The UV light unit may further comprise a cooling body and/or a fan for cooling the UV LEDs. The UV LEDs may be configured to emit a UV light spectrum, preferably a UV-B and/or UV-C light spectrum in a wavelength range between 200 nm and 315 nm, further preferred between 240 nm and 315 nm, for curing the printing inks. It is also imaginable that the UV LEDs are configured to emit a UV-A light spectrum in a wavelength range of 315 nm to 410 nm for the purpose of pinning. Likewise, it is imaginable that the UV light unit comprises different UV LED types of the UV-A, UV-B and/or UV-C type, which are preferably configured to emit UV-C and/or UV-B light for curing after the application of all printing inks and/or UV-A light for pinning between the application of different printing inks. It is also imaginable that the UV light unit comprises UV LEDs with different UV light spectra, which can also be controlled differently so as to effect better curing of different printing inks.

The 2D arrangement of LEDs may be a random 2D arrangement or a regular 2D grid arrangement, in which the UV LEDs are distributed on a flat or on a curved surface. The 2D arrangement of UV LEDs can be a hexagonal or a matrix arrangement of a plurality of UV LEDs. The 2D arrangement of UV LEDs makes it possible to irradiate the containers with UV light over a substantially long conveyance section and to thus achieve the desired curing of the printing ink.

The UV light field can be defined as the light field of all UV LEDs of a UV light unit that are switched on during operation.

The curing station may comprise a control unit for controlling the UV light unit, the container holders and/or the conveyor by open-loop or closed-loop control. Preferably, the control unit may be connected to the UV light unit, the container holders and/or the conveyor via electric lines.

The UV LEDs of the at least one UV light unit may be configured to be controllable individually or in groups, so as to control the UV light field depending on conveyance positions of the containers relative to a curing and/or pinning section of the curing station. This allows the UV LEDs to emit, in the area of the curing and/or pinning section, UV light only where a container is actually present. The UV LEDs can thus be switched off between the conveyance positions of the containers and cool down consequently. As a result, less effort is required for cooling and the UV light unit works more efficiently. That "the UV LEDs are controllable individually or in groups" can here mean that the UV LEDs are controllable in a digital or in an analog manner, individually or in groups, so as to switch them on, switch them off and/or switch them to any dimmed state. The UV light field can thus be caused to follow the container conveyance, whereby a longer distance for curing is obtained. Hence, the same curing effect can be achieved with a lower radiation output. Consequently, less ozone is formed and also UV LEDs with lower radiation output can be used. In addition, the size, the radiation characteristics, the UV light spectrum and the intensity of the UV light field can be adapted particularly easily to the required irradiation effect at the container. Preferably, a dimmed state is accomplished by changing the pulse/pause ratio.

The curing section may be an area of the conveying path of the conveyor, which is provided for curing the printing ink on the containers. The curing section may be arranged downstream of at least one printing station comprising direct printing heads. In other words, it may be a section of the conveying path where all printing inks of the direct print have already been applied to the containers by means of the printing station during operation.

The pinning section may be arranged between two printing stations and/or between two direct printing heads and provided for curing a first printing ink before a further printing ink is applied. In this way, the first printing ink can be cured by the UV light unit before the subsequent, second printing ink is printed. As a result, the two printing inks will not run into each other and a better print image is produced. This allows the UV light unit to be used for pinning in addition to curing.

A control unit may be configured to change the UV light field by controlling the output of at least one of the UV LEDs. In this way, it is possible, by means of a control procedure stored in the control unit, to flexibly adapt the UV light field to the container shape and/or to the direct print and/or to cause it to follow the container conveyance. It is imaginable that the output control of the UV LEDs may be effected by changing at least one current, at least one voltage or a pulse/pause ratio of a PWM signal.

Preferably, the control unit may be configured to change the outputs of the UV LEDs on the basis of conveyance positions of the containers relative to the curing and/or pinning section of the curing station, so as to cause the UV light field to follow the conveyance of the containers. Preferably, the control unit may be connected to an encoder, which detects the conveyance positions of the containers at the conveyor. The encoder may be a rotary encoder on a carousel axis to detect the rotary position of the carousel and thus of the container holders. It may also be a light barrier, a camera or the like, so as to detect the containers at the conveyor and determine the conveyance positions therefrom.

The control unit may be configured to change the outputs of the UV LEDs based on a distance between the respective UV LED and a container to be cured, so as to homogenize the UV light field acting on the printing ink on the container. In this way, a container area remote from the UV light unit can be cured just as quickly as a container area close to it. In addition, the distance between the UV light unit and the container can be reduced, since the radiation output acting on the closely-spaced container area is correspondingly reduced such that the container or the direct print will not be damaged by the UV light. It is also imaginable that the control unit is configured to change the outputs of the UV LEDs based on local area orientations of the container surface relative to the UV light field. This will compensate the orientation of different surface areas on the container relative to the UV light field acting thereon.

The UV LEDs may have assigned thereto at least one UV sensor for detecting and/or controlling a radiation intensity of one or of a plurality of the UV LEDs, the UV sensor being in particular connected to the control unit. This allows a compensation of production- and ageing-dependent fluctuations of the radiation output of the UV LEDs. It is imaginable that the UV sensor is a photodiode or a phototransistor that is sensitive to UV light. A light entry surface of the UV sensor may be oriented in the direction of at least one assigned UV LED.

For conveying the containers the conveyor may be configured with container holders, a respective one of the UV light units being arranged at each of the container holders such that it moves together therewith. In this way, the UV light units can be used in a particularly flexible manner, e.g. for pinning between the printing of two printing inks and, subsequently, for curing. In addition, curing can take place together with the conveyance of the containers along the curing section. For example, the conveyor may be configured as a carousel, each container holder having assigned thereto a curing station radially inside or outside. It is also imaginable that each container holder on the carousel has assigned thereto a printing station for printing the direct print and a curing station for curing the direct print. It is imaginable that the container holders and/or the UV light units are enclosed in a treatment labyrinth, the respective UV light unit being preferably controllable by the control unit such that the UV light field is activable between two direct printing heads and deactivable at the position of a direct printing head. This allows pinning between the printing of two printing inks, so that different printing inks will not run into one another. Moreover, the treatment labyrinth has the effect that only little stray light of the UV light units, or no stray light at all, will arrive at the direct printing heads. The function of the printing nozzles will thus not be impaired by cured printing ink. The treatment labyrinth may comprise shielding elements defining a housing for the container holders and/or the UV light unit. The shielding elements may define one or a plurality of access openings for printing and/or for curing the printing ink.

The at least one UV light unit may be arranged stationarily at the curing station. The UV light unit may be configured for moving the UV light field along with the conveyance of the containers, preferably by switching the UV LEDs. The supply lines can thus be routed particularly easily to the UV light unit, without using a rotary distributor. "Stationary" may here mean that the UV light unit is fixedly connected to a machine base or a support frame of the curing station. It is imaginable that, if the conveyor is configured as a carousel, the UV light unit is arranged radially inside or outside a conveying path of the conveyor. In the case of a linear conveying unit, the UV light unit may be arranged laterally along a conveying path. The conveying path may be a path along the conveyance positions of the containers. In other words, it may be the path along which the container holders are moved by the conveyor during conveyance. Preferably, the UV light unit may be configured to emit the UV light in the direction of the container holders and/or transversely to a conveying direction of the conveyor.

The conveyor may be a carousel with a hollow shaft, and the at least one UV light unit is arranged centrally on the hollow shaft. In this way, a particularly simple and compact structural design of the curing station is obtained. The UV light unit may here be arranged stationarily and protrude through the hollow shaft with a supporting foot. In this arrangement, the UV LEDs may be arranged outside the hollow shaft, preferably vertically above a carousel plane, in order to radiate UV light onto the containers in the container holders. Preferably, a radiation direction of the UV light may be transverse, preferably vertical to a carousel axis. It is also imaginable that the UV light unit comprises a chimney-like cooling body, which is arranged centrally on the hollow shaft and on which the UV LEDs are arranged. A fan is preferably arranged on the chimney-like cooling body. This allows the heat of the UV LEDs to be dissipated particularly well.

For solving the posed task, the present invention additionally provides a direct printing machine used for printing on containers. The direct printing machine may comprise the above described features individually or in arbitrary combinations.

As has been explained above in more detail with respect to the curing station, the use of the 2D arrangement of UV LEDs for generating the UV light field for curing the printing ink requires less effort and is more flexible. This also applies to the printing station in a corresponding manner.

That the at least one printing station is configured as a separate unit may here mean that the printing station and the curing station each have a support frame of their own to support them on a floor. Also the printing station's own conveyor may be configured as a carousel or as a linear conveying unit. The printing station may be connected to the curing station via a further conveyor.

The printing station may comprise one or a plurality of direct printing heads for printing the direct print onto the containers preferably according to the ink jet principle. The direct printing heads may each comprise at least one nozzle row with printing nozzles for applying the printing ink onto the containers in the form of ink droplets.

The conveyor may comprise rotatable container holders for rotating the containers relative to the direct printing heads. In this way, the containers can be printed on around their full circumference. For rotating the containers, the container holders may each comprise a direct drive, a rotary table for accommodating the container base and/or a centering bell for accommodating the container mouth.

Alternatively, it is imaginable that the at least one printing station is arranged at the conveyor of the curing station. This allows a particularly compact structural design of the direct printing machine. In addition, the conveyor can be used for applying the printing ink as well as for curing. It is imaginable that a plurality of printing stations comprising each at least one direct printing head is arranged at the conveyor. The printing stations may also be configured as satellite printing stations. Alternatively, the printing stations may be formed at the conveyor such that they move together with the carousel and, preferably, they may each be assigned to a respective container holder. In this way, a container is printed on with all printing inks and cured in a printing station on the carousel.

For solving the posed task, the present invention additionally provides a method used for curing printing ink of a direct print on containers. The method may comprise, mutatis mutandis, the features described hereinbefore with respect to the curing station and/or the direct printing machine, individually or in arbitrary combinations.

Due to the fact that, by means of the at least one UV light unit, a UV light field for curing the printing ink is generated through the 2D arrangement of UV LEDs by means of LED technology, the UV light is generated more efficiently and can be switched particularly quickly. Hence, the UV light unit develops less heat and can be switched on and off particularly fast, without any warm-up time. Due to the fact the present light source is not a single UV light source but a 2D arrangement of a plurality of UV LEDs, the UV LEDs can be controlled individually, so that the UV light field will be adapted to the actual curing demands individually to the container shape and the size of the direct print, respectively. In addition, due to the adaptation of the UV light field, the containers can be moved past the UV light unit at a particularly small distance therefrom, without the surface area positioned closest to the UV light source being excessively irradiated. As a result, the entire radiation output required is not as high as in the case of known UV light sources. It follows that the method requires less effort and is more flexible in use.

The fact that the UV LEDs are switchable has a particularly advantageous effect in preventing light pollution with respect to the print heads. In this way, it can be ensured by control measures that the UV light unit is switched off whenever a container is conveyed out of a treatment labyrinth/chamber area and stray light could fall on one of the direct printing heads.

The UV light units can move along with the conveyance of the containers, the UV light fields being generated depending on conveyance positions of the containers and/or the container holders relative to a curing and/or pinning section of the curing station. This allows a particularly flexible use of the UV light unit, e.g. for pinning between the printing of two printing inks and, subsequently, for curing.

The at least one UV light unit may be arranged stationarily, the UV light field being caused to follow a conveyance movement of the containers by controlling, preferably by switching on and off, the UV LEDs depending on the conveyance movement. The UV light unit can here cause the UV light field to follow the conveyance of the containers. The supply lines can thus be routed particularly easily to the UV light unit, without using a rotary distributor.

According to a particularly advantageous embodiment, the UV irradiation unit comprises a mixture of different UV light spectra. In this way, it is possible to expose differently preset, UV-curing printing inks with the correct spectrum and the correct dose of the respective spectrum required.

The UV LEDs can be controlled based on the distance between the respective UV LED and a container to be cured, so as to homogenize the UV light field acting on the printing ink on the container. In this way, a container area remote from the UV light unit can be cured just as quickly as a container area close to it.

A UV sensor may measure a radiation intensity of one or of a plurality of the UV LEDs and control the radiation intensity accordingly. This allows a compensation of production- and ageing-dependent fluctuations of the radiation output of the UV LEDs.

BRIEF DESCRIPTION OF THE FIGURES

Further features and advantages of the present invention will be explained in more detail hereinafter on the basis of the embodiments shown in the figures, in which.

DETAILED DESCRIPTION

Figure 1A:
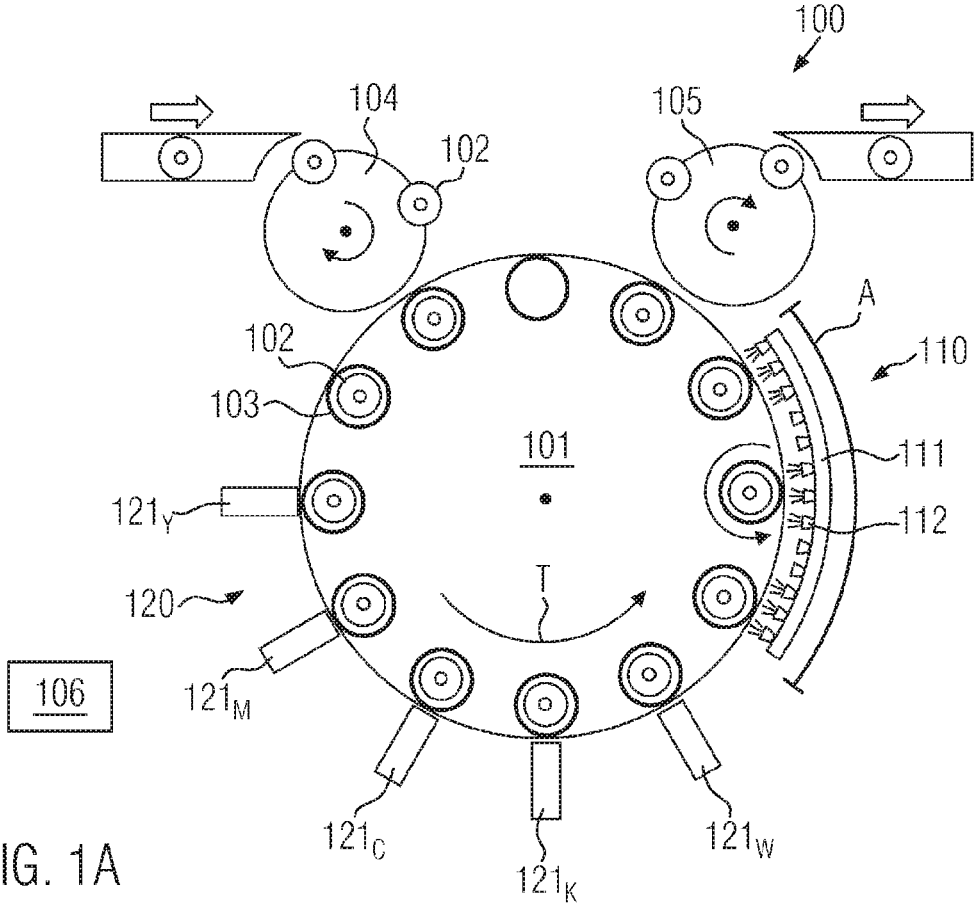
FIG. 1A shows an embodiment of a printing station and of a curing station in a top view.
Figure 1B:
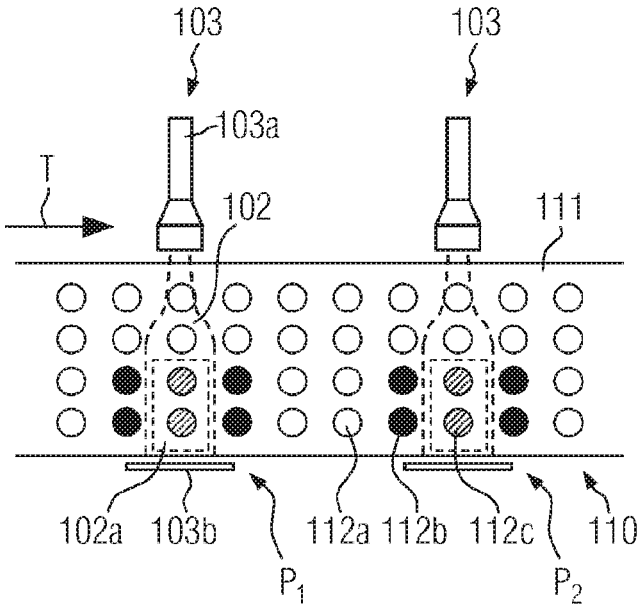
FIG. 1B-1C show detail views of the curing station according to FIG. 1A in a side view and in a top view.
Figure 1C:
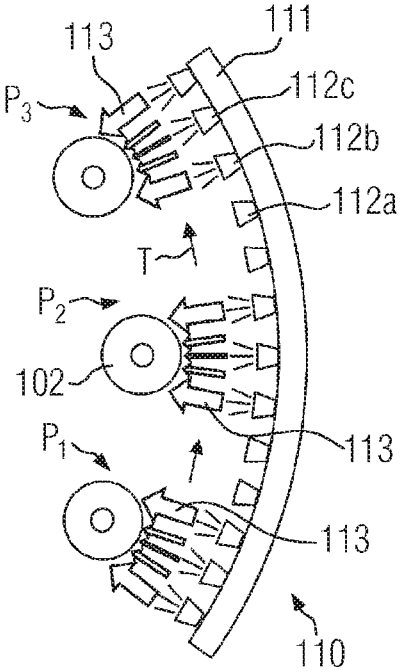

FIG. 1A-1C show an embodiment of a printing station 120 and of a curing station 100 in a top view. What can be seen are the containers 102, which are transferred by means of the infeed starwheel 104 to the conveyor 101, where they are received in the container holders 103. The conveyor 101 is here configured e.g. as a carousel, which rotates about a vertical axis in the direction T and thus moves the containers 102 past the printing station 120 for applying a direct print and past the UV light unit 110. Subsequently, the containers 102 are transferred to the discharge starwheel 105 and advanced so as to undergo further treatment steps.

The printing station 120 comprises a plurality of direct printing heads $\mathbf{121}_Y$, $\mathbf{121}_M$, $\mathbf{121}_C$, $\mathbf{121}_K$ and $\mathbf{121}_W$, each having one or a plurality of rows of nozzles operating according to the ink jet principle. In the printing station 120, the containers 102 have successively printed thereon a plurality of raster images in yellow, magenta, cyan, black and white, which overlap so as to form a color direct print identifying the content of the containers 102. The respective printing inks are curable with UV light and can therefore be dried very quickly. For circumferential printing or printing around the full circumference, the containers 102 are additionally rotated relative to the direct printing heads $\mathbf{121}_Y$, $\mathbf{121}_M$, $\mathbf{121}_C$, $\mathbf{121}_K$ and $\mathbf{121}_W$ by means of the container holders 103. To this end, the container holders 103 each have a rotary table 103*b*, which is adapted to be rotated by a direct drive, and a centering bell 103*a*.

For curing the printing ink, the containers 102 are moved past the UV light unit 110, which is stationarily arranged at the curing station 100. The UV light unit 110 comprises a carrier plate 111 and a matrix arrangement of UV LEDs 112 for generating a UV light field 113. The UV light field 113 can thus be caused to follow the conveying direction T of the containers 102 by switching the UV LEDs on and off or dimming them in a suitable manner by the control unit 106. The printing inks are thus cured, so that they will no longer run into one another and will be scratch-resistant.

The structure of the UV light unit 110 is shown in more detail in FIG. 1B from the side and in FIG. 1C from above. In FIG. 1B it can be seen that the UV LEDs 112 are attached to the carrier plate 111 in a matrix arrangement. The 2D arrangement extends e.g. over the entire height of the containers 102 along the curing section A shown in FIG. 1A. In addition, all UV LEDs 112 work with a wavelength in the UV light spectrum, preferably in the UV-B or UV-C range.

The structure of the UV light unit 110 may comprise a mixed assembly of various types of UV LEDs with different UV light spectra in order to be able to process differently preset, UV-curing printing inks. The required UV light spectra can be activated according to demand and position, this means e.g. that a front print will be cured with 280 nm while a back print will be fixed with 310 nm.

It can also be seen that most UV LEDs 112*a* are switched off, since they are either not located opposite the container 102 or outside an irradiation zone for direct printing 102*a*, which does here not extend over the full height of the container 102 but only on the container belly. The UV LEDs 112*b*, however, are switched on with higher intensity and the UV LEDs 112*c* with lower intensity. As can be seen in more detail in FIG. 1C, this results in a UV light field 113 with higher intensity at the container areas spaced apart from the UV LEDs 112 at a greater distance and with lower intensity at the container areas spaced apart from the UV LEDs 112 at a smaller distance. This homogenizes the UV light field 113 acting on the direct print 102*a* and curing takes place in a particularly uniform manner.

In addition, it can be seen in FIGS. 1B and 1C that the UV light field 113 is caused to follow the container conveyance in the direction T. To this end, the UV LEDs 112 of the UV light unit 110 are controlled, individually or in groups, depending on the respective conveyance position $P_1$, $P_2$, $P_3$ of the containers 102 relative to the curing section A and the UV light unit 110, respectively. This means that the UV light field 113 virtually migrates along with the conveyance movement of the containers 102.

In addition, the containers 102 can be rotated in the container holders 103 by means of the rotary tables 103*b* while being conveyed in the direction T, so as to cure e.g. a rear direct print, which is here not shown.

Due to the fact that the UV light unit 110 comprises the matrix arrangement of UV LEDs 112, the UV light field 113 can be caused to follow the conveyance movement of the containers 102 during the curing process and will thus act on the printing ink of the direct print 102*a* over a longer period of time. Hence, the printing ink can be sufficiently cured with a lower radiation output of the UV LEDs 112, without ozone being generated and without the necessity of cooling a high heat output. In addition, the UV LEDs 112 can be switched very fast and the UV light field 113 can directly be adapted to various direct print sizes. A warm-up time can be dispensed with as well. Moreover, the UV LEDs work in UV-A and/or UV-B, so that eye protection will be less complicated. It follows that the curing station 100 and the direct printing machine 120, 100 are less complicated and more flexible in use.

FIG. 2A-2E show a further embodiment of a printing station 220 and a curing station 200. The embodiment essentially differs from the above insofar as, instead of the stationary UV light unit 110 according to FIG. 1A-1C, the UV light units 210 are arranged at the container holders 203 such that they move together therewith.

The printing station 220 comprising the direct printing heads $\mathbf{221}_Y$, $\mathbf{221}_M$, $\mathbf{221}_C$, $\mathbf{221}_K$ and $\mathbf{221}_W$ corresponds, as regards structure and function, to the printing station 120 according to FIG. 1A-1C.

Figure 2A:
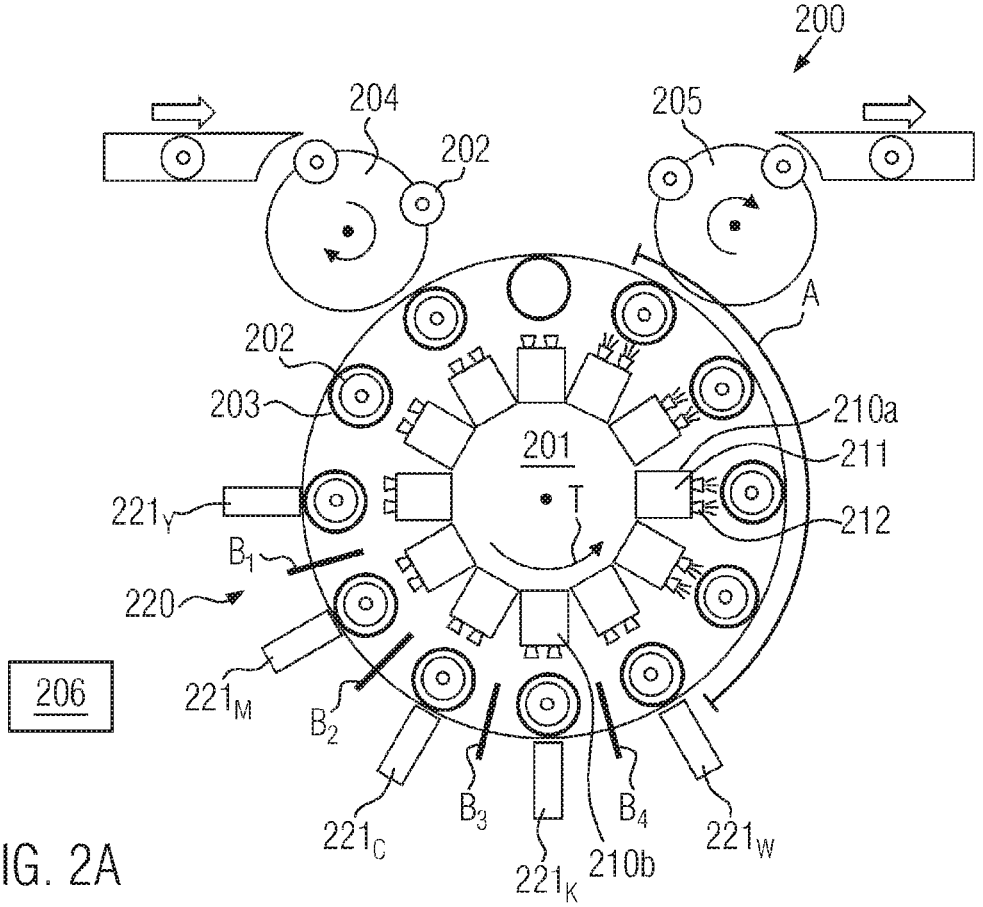
FIG. 2A shows a further embodiment of a printing station and of a curing station in a top view.
Figure 2B:
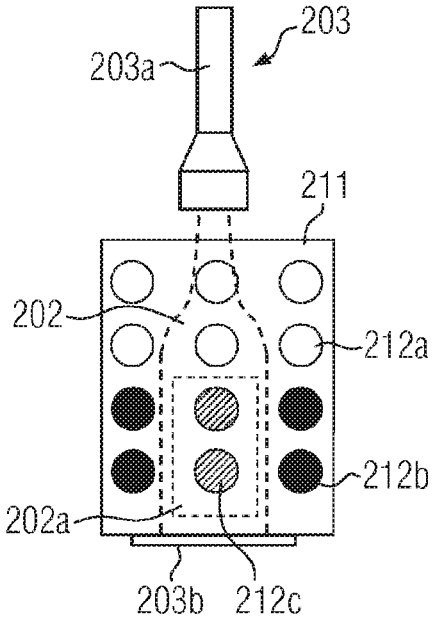
FIG. 2B-2C show detail views of the curing station according to FIG. 2A in a side view and in a top view.
Figure 2C:
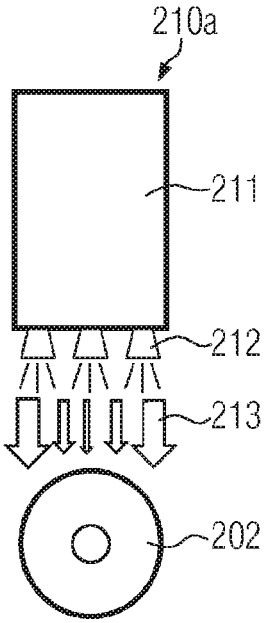

FIG. 2B-2C show a container holder 203 and the associated curing station 210*a* in a side view and in a top view, in which the container 202 is just being cured. This is done in the curing section A during conveyance after printing with the last direct printing head $\mathbf{221}_W$ has been carried out.

What can be seen is that the UV light unit 210 comprises a carrier 211 and a matrix arrangement of UV LEDs 212, which generates the UV light field 213 for curing the printing ink. The UV light unit 210 is arranged on the carousel 201 and is conveyed by the latter, together with the respective container holder 203, in the conveying direction T.

During printing with the direct printing heads $\mathbf{221}_Y$, $\mathbf{221}_M$, $\mathbf{221}_C$, $\mathbf{221}_K$ and $\mathbf{221}_W$, the UV light units 210*a* are deactivated by the control unit 206, so as to prevent a curing of printing ink in the printing nozzles, which may lead to malfunction.

However, the UV light units 210 are controlled by the control unit 206 in the pinning sections $B_1B_4$, i.e. depending on the conveyance position of the respective containers 202 between the direct printing heads $\mathbf{221}_Y$, $\mathbf{221}_M$, $\mathbf{221}_C$, $\mathbf{221}_K$ and $\mathbf{221}_W$, in such a way that the printing ink which has just been printed on is slightly cured (pinning) by the UV LEDs 212 so that it will not run into the subsequently applied printing ink.

In addition, the control unit 206 controls the outputs of the UV LEDs 212 on the basis of the conveyance position of the respective container holder 203, individually or in groups, such that, based on a distance of the respective UV LED 212 from the container 202, the UV LEDs will generate a homogeneously effective UV light field 213 in the curing section A. This is shown in more detail in FIGS. 2B and 2C. Since in this example, the direct print is only provided on the container belly, the upper UV LEDs 212 are deactivated, so that no unnecessary heat output will be generated. The two lateral UV LED groups 212*b*, however, are switched on with higher intensity and the UV LEDs 212*c* with lower intensity. As can be seen more precisely in FIG. 2C, this results in a UV light field 213 with a higher intensity at the container areas spaced apart from the UV LEDs 212 at a large distance and with a lower intensity at the container areas spaced apart from the UV LEDs 212 at a small distance. This homogenizes the UV light field 113 acting on the direct print 202*a* and curing takes place in a particularly uniform manner.

In addition, the curing section A spans a larger area of the conveying path subsequent to the printing station 220 and up to the discharge starwheel 205, so that the printing ink on the container 202 can be irradiated longer. In this way, a sufficient curing effect will be accomplished even with a lower radiation output of the UV LEDs 212.

It is imaginable that the UV light units 210 comprise UV LEDs 212 in the UV-A range for pinning as well as in the UV-B and/or UV-C range for curing.

Furthermore, the rotary tables 203*b* of the container holders 203 are configured to be rotatable by a direct drive. During the curing process, it is therefore possible to rotate the containers 202 so as to cure the printing ink of a direct print applied to the back of the container.

Since each container holder 203 has assigned thereto a UV light unit 210, the curing station 200 according to FIG. 2A-2C can be used in a particularly flexible manner.

Figure 2D:
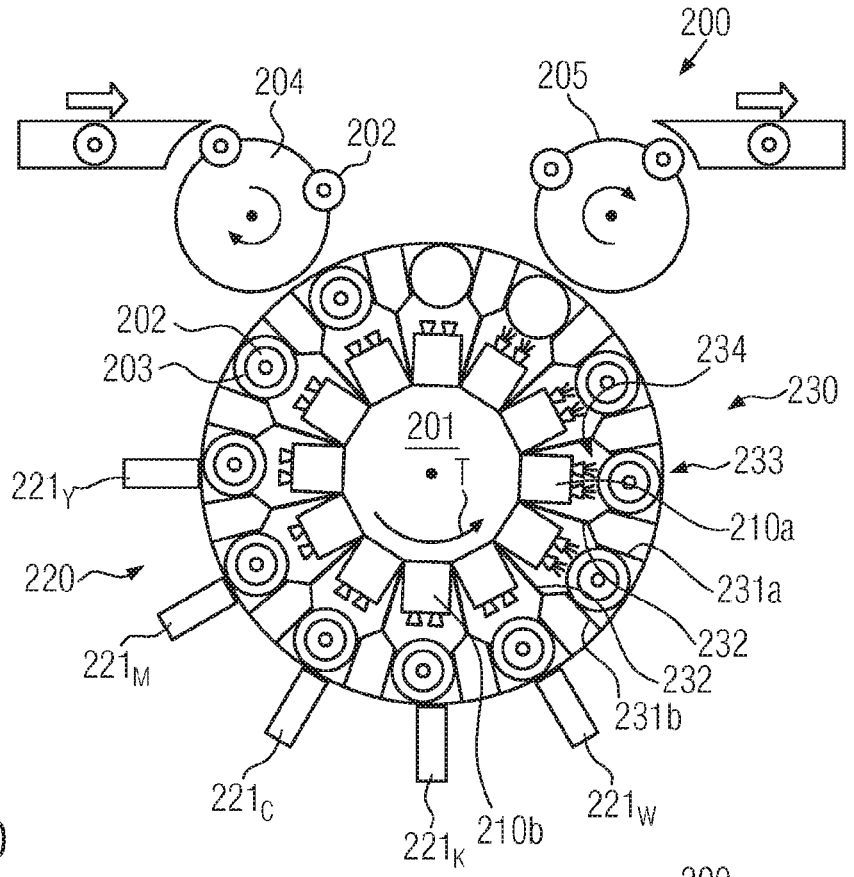
FIG. 2D-2E show, in a top view, the printing station and the curing station according to FIG. 2A with an additional treatment labyrinth during operation.
Figure 2E:
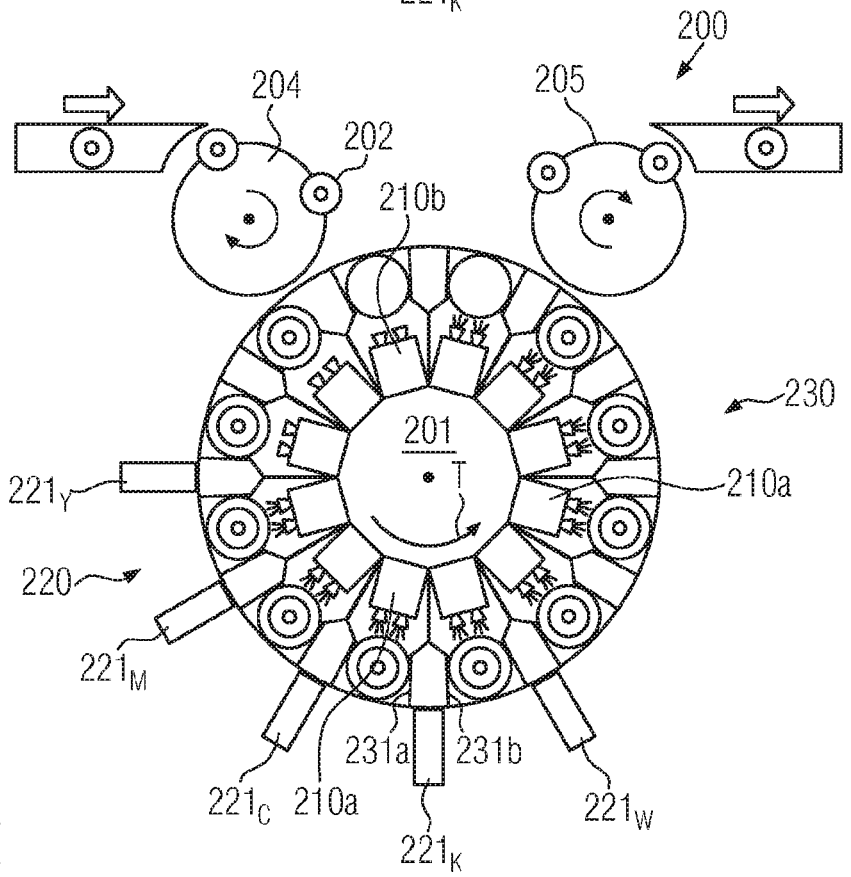

In FIG. 2D-2E, the printing station 220 and the curing station 200 of FIG. 2A are shown in a top view with an additional treatment labyrinth 230 during operation. What can be seen is that the treatment labyrinth 230 with the shielding elements 231*a*, 231*b* and 232 is arranged on the conveyor 201 between the individual container holders 203. The shielding elements 231*a*, 231*b* define a housing for the container holders 203, and the shielding elements 232 do so likewise for the UV light units 210.

In this way, chambers are formed, which each contain a UV light unit 210 and a container holder 203, these chambers shielding the neighboring chambers from the stray light. In addition, the shielding elements 231*a*, 231*b*, 232 are configured such that for each chamber a first access opening 233 for the direct printing heads 221 and a second access opening for the respective associated UV light unit 210 is formed.

In FIG. 2D it can be seen that the containers 202 are just being cured subsequent to the last direct printing head $\mathbf{221}_W$, the UV light units 210*a* between the last direct printing head $\mathbf{221}_W$ and the discharge starwheel 205 being here activated. Conversely, the other UV light units 210*b* are deactivated at this moment in time, since at some of the treatment positions containers 202 are just printed on by the direct printing heads 221 through the access openings 230. In this way, printing ink is prevented from being cured directly on the direct printing heads 221 and from thus impairing the function of the latter.

Furthermore, it can be seen in FIG. 2E that the conveyor 201 has been rotated a little further and that the containers 202 are just located at positions between the direct printing heads 221. In this area, stray light from the UV light units 210*a* is shielded off by the treatment labyrinth 230, preferably by the shielding elements 231*a*, 231*b*, such that it cannot arrive at the inactive direct printing heads 221. Consequently, this position of the conveyor 201 allows the UV light units 210*a* to be activated so as to pin, through the access openings 234, the printing ink between the individual direct printing heads 221. In this way, an even sharper print result is accomplished.

Figure 3:
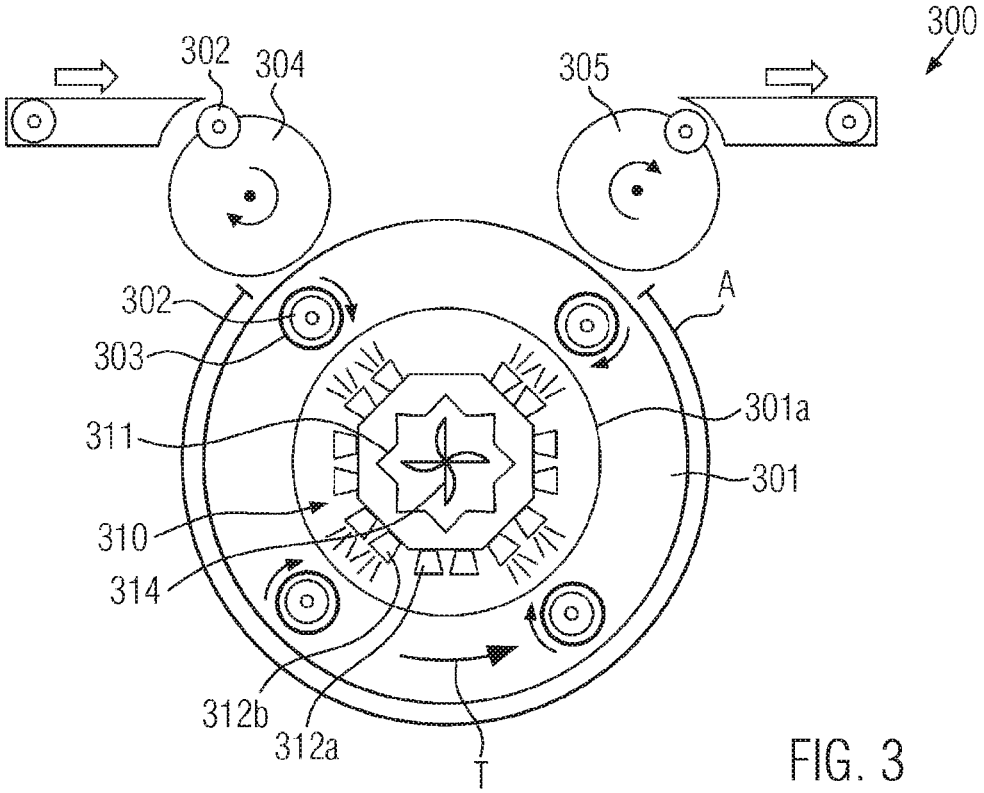
FIG. 3 shows a further embodiment of a curing station with a carousel as a conveyor in a top view.

FIG. 3 shows a further embodiment of a curing station 300 with a carousel as a conveyor 301 in a top view. The embodiment differs from that in FIG. 1A-1C essentially insofar as the conveyor is configured as a carousel 301 with a hollow shaft 301*a* and the UV light unit 310 is arranged centrally in the hollow shaft 301*a* instead of peripherally on the outer circumference. In addition, the printing station is not arranged on the conveyor 301 of the curing station 300, but as a separate unit, which has its own conveyor and which is not shown here. The printing station is arranged upstream of the curing station, so that the containers 302 that have already been provided with the printing ink are transferred to the container holders 303 of the curing station 300 by means of the infeed starwheel 304.

What can be seen is that the UV light unit 310 is configured with a columnlike, hollow cooling body 311, which defines a chimney and which is adapted to be forced-ventilated via the fan 314. The UV LEDs 312 are arranged on the outside of the cooling body 311 above the carousel plane such that they are directed radially outwards. In this way, the UV light field is radiated substantially radially outwards and the printing ink on the containers 302 is cured. In order to allow all container areas to be cured all around, the container holders 303 are configured to be rotatable, so that the containers 302 can be rotated about their longitudinal axes.

The outputs of the UV LEDs are controlled individually or in groups by a control unit, which is here not shown, based on conveyance positions of the containers 302 relative to the curing section A. Thus, the UV light field is caused to follow the conveyance of the containers in the direction T, without the necessity of rotating the UV light unit 310. As a result, the UV light unit 310 can be controlled without a rotary distributor and has therefore a particularly simple structural design.

Figure 4:
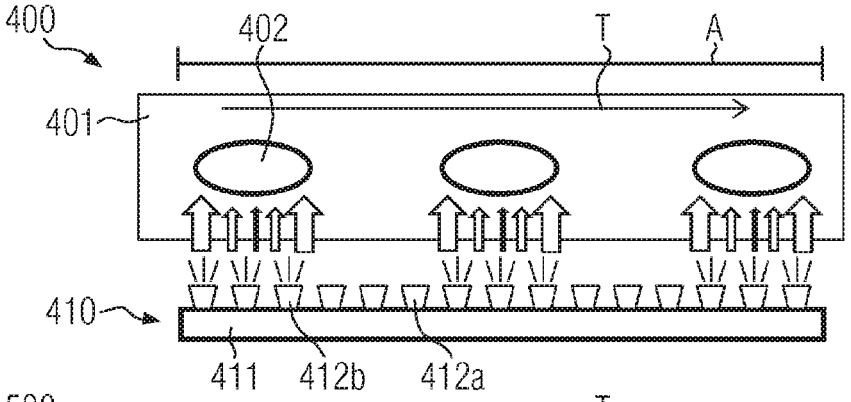
FIG. 4 shows a further embodiment of a curing station with a linear conveying unit as a conveyor in a top view.

FIG. 4 shows a further embodiment of a curing station 400 with a linear conveying unit 401 as a conveyor in a top view. What can be seen is that the containers 402, which have already been provided with printing ink by a printing station that is not shown, are conveyed by means of the linear conveying unit 401 along the UV light unit 410 that is provided with carrier 411 and cured while moving therealong. The UV light unit 410 comprises also in this case a matrix arrangement of UV LEDs 412, which generate a UV light field for curing the printing ink. It can also be seen that most of the UV LEDs 412*a* are switched off, since they are not located opposite the container 402. The UV LEDs 412*b*, however, are switched on with different intensities, based on a distance between the respective UV LED 412*b* and the container 402, so as to homogenize the UV light field acting on the printing ink on the container 402. In this way, curing takes place in a particularly uniform manner.

In addition, the UV light field is caused to follow the container conveyance by switching the UV LEDs 412. To this end, the UV LEDs 412 of the UV light unit 410 are controlled individually or in groups by means of a control unit, which is here not shown, depending on the respective conveyance position of the containers 402 relative to the curing section A and the UV light unit 410, respectively. This means that the UV light field virtually migrates along with the conveyance movement of the containers 402.

It follows that a curing station 400 with a 2D arrangement of UV LEDs 412 can also be used in the case of a linear conveying unit 401. The curing station 400 is thus comparatively uncomplicated and can be used in a flexible manner.

Figure 5:
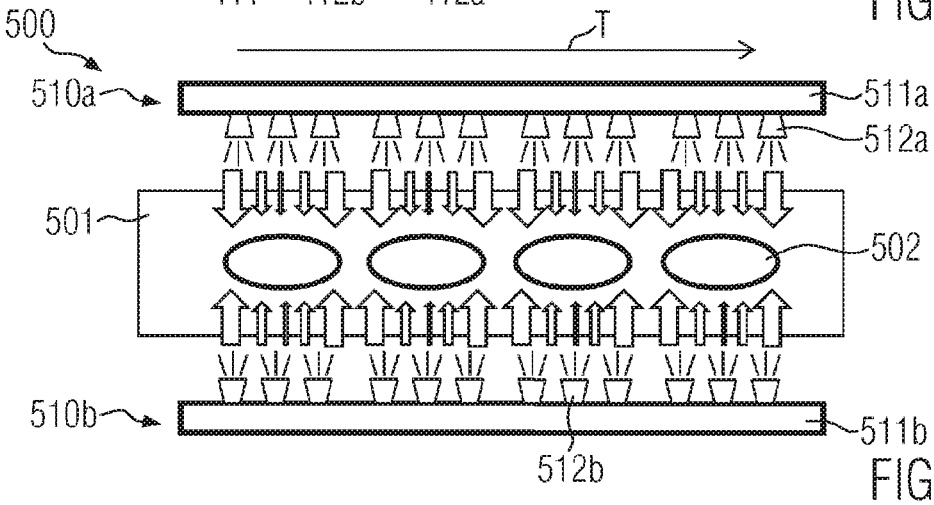
FIG. 5 shows a further embodiment of a curing station with a linear conveying unit as a conveyor in a top view.

FIG. 5 shows a further embodiment of a curing station 500 with a linear conveying unit 501 as a conveyor in a top view. The embodiment differs from that in FIG. 4 only insofar as two UV light units 510*a*, 510*b* are here arranged in opposed relationship at the linear conveying unit 501. Each of the two UV light units 510*a*, 510*b* is provided with a carrier 511*a*, 511*b* and a matrix arrangement of UV LEDs 512*a*, 512*b*. Both UV light units 510*a*, 510*b* work like the UV light unit 410 that has been described above with respect to FIG. 4 and, accordingly, they are controlled by means of a control unit, which is here not shown, such that the UV light fields are caused to follow the conveyance of the containers 502.

Due to the fact that the UV light units 510*a*, 510*b* are formed at the linear conveying unit 501 on both sides thereof, both container sides can be cured simultaneously and without rotating the containers. The curing station 500 thus works in a particularly efficient manner. It is also imaginable that two opposed UV light units are arranged along the conveying path in the case of the curing stations 100, 200, 300 in FIG. 1A-3.

Figure 6:
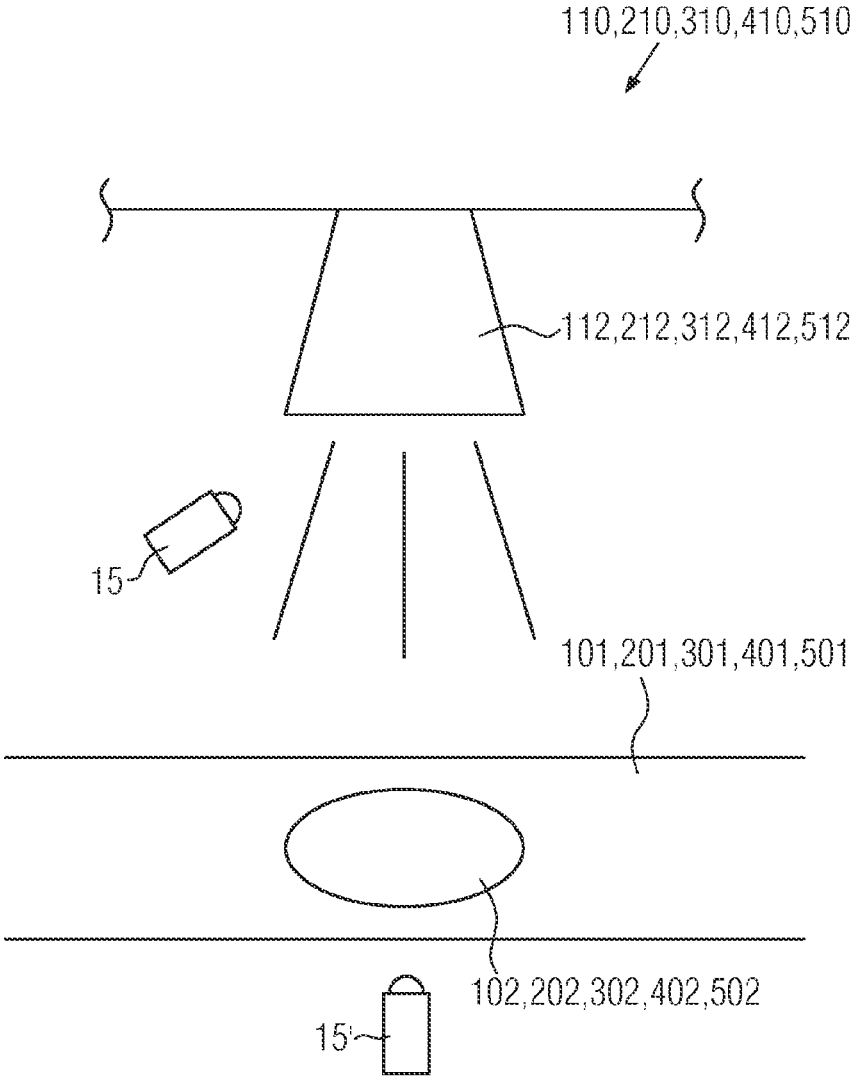
FIG. 6 shows an embodiment of a UV LED according to FIG. 1-5 with a UV sensor in a top view.

FIG. 6 shows an embodiment of a UV LED 112, 212, 312, 412, 512 of the type used for the curing stations 100, 200, 300, 400, 500 of FIG. 1-5. In addition, the UV sensor 15 can be seen, which measures the radiation intensity of the UV light and transmits a corresponding signal to the control units. Since the radiation output of UV LEDs varies in a production- and ageing-dependent manner, this can be detected by the UV sensor 15 and compensated for by means of an appropriate control, preferably current control, or change of the PWM.

It is also imaginable that the UV sensor 15' is arranged at the conveyor 101, 201, 301, 401, 501 in opposed relationship with the UV LED 112, 212, 312, 412, 512, whereby the radiation intensity in the forward direction is particularly well detected.

It goes without saying that the features described in the above embodiments are not limited to these combinations, but can be provided individually or in any other combination.

The invention claimed is:

1. A curing station for curing printing ink of a direct print on containers, comprising:

a conveyor for conveying the containers; and at least one UV light unit for curing the printing ink, wherein the at least one UV light unit comprises a 2D arrangement of UV LEDs for generating a UV light field for curing the printing ink, wherein the UV LEDs of the at least one UV light unit are configured to be controllable individually or in groups, so as to control the UV light field depending on conveyance positions of the containers relative to a curing and/or pinning section of the curing station, the curing station further comprising a control unit configured to change the UV light field by controlling an output of at least one of the UV LEDs, and wherein the control unit is configured to change the outputs of the UV LEDs on a basis of conveyance positions of the containers relative to a curing and/or pinning section of the curing station, so as to cause the UV light field to follow the conveyance of the containers.

2. The curing station according to claim 1, wherein the control unit is configured to change the output of the at least one of the UV LEDs based on a distance between a respective UV LED and a container to be cured, so as to homogenize the UV light field acting on the printing ink on the container.

3. The curing station according to claim 1, wherein the UV LEDs have assigned thereto at least one UV sensor for detecting and/or controlling a radiation intensity of one or of a plurality of the UV LEDs.

4. The curing station according to claim 3, wherein the at least one UV sensor is connected to the control unit.

5. The curing station according to claim 1, wherein the conveyor is configured for conveying the containers with container holders, a respective one of the UV light units being arranged at each of the container holders such that it moves together therewith.

6. The curing station according to claim 1, wherein the at least one UV light unit is arranged stationarily at the curing station.

7. The curing station according to claim 6, wherein the conveyor is a carousel with a hollow shaft, and wherein the at least one UV light unit is arranged centrally on the hollow shaft.

8. A direct printing machine for printing a direct print on containers, comprising:

at least one curing station according to claim 1; and at least one printing station for applying the printing ink of the direct print to containers, wherein the at least one printing station is configured as a separate unit which has a conveyor of its own and which is arranged upstream of the curing station, or wherein the at least one printing station is arranged at the conveyor of the curing station.

9. The curing station according to claim 1, wherein the conveyor conveys the containers in container holders.

10. A method of curing printing ink of a direct print on containers, comprising:

conveying the containers; and curing the printing ink by means of at least one UV light unit during such conveyance, wherein the at least one UV light unit generates a UV light field for curing the printing ink by a 2D arrangement of UV LEDs, wherein the UV light units move along with the conveyance of the containers, and wherein the UV light fields are generated depending on conveyance positions of the containers relative to a curing section and/or pinning section of a curing station; or wherein the at least one UV light unit is arranged stationarily, and wherein the UV light field is caused to follow a conveyance movement of the containers by controlling the UV LEDs depending on the conveyance movement.

11. The method according to claim 10, wherein the UV LEDs are controlled based on a distance between a respective UV LED of the UV LEDs and a container to be cured, so as to homogenize the UV light field acting on the printing ink on the container.

12. The method according to claim 10, wherein a UV sensor measures a radiation intensity of one or of a plurality of the UV LEDs, and wherein the radiation intensity is controlled based on the measured radiation.

13. The method according to claim 10, wherein the UV LEDs are controlled by switching the UV LEDs on and off.

14. The method according to claim 10, wherein the containers are conveyed in container holders of the conveyor.

* * * * *